US008498428B2

(12) United States Patent
Schreuder et al.

(10) Patent No.: US 8,498,428 B2
(45) Date of Patent: Jul. 30, 2013

(54) FULLY INTEGRATED SMALL STEREO HEADSET HAVING IN-EAR EAR BUDS AND WIRELESS CONNECTABILITY TO AUDIO SOURCE

(75) Inventors: Johannes Lucas Schreuder, Ees (NL); Jan-Willem Zweers, Nieuwleusen (NL); Franciscus Nicolaas Martinus Hooijschuur, Emmen (NL)

(73) Assignee: Plantronics, Inc., Santa Cruz, CA (US)

( * ) Notice: Subject to any disclaimer, the term of this patent is extended or adjusted under 35 U.S.C. 154(b) by 21 days.

(21) Appl. No.: 13/184,634

(22) Filed: Jul. 18, 2011

(65) Prior Publication Data

US 2012/0052810 A1 Mar. 1, 2012

Related U.S. Application Data

(60) Provisional application No. 61/377,359, filed on Aug. 26, 2010.

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS 5,121,046 A * 6/1992 McCullough ..... 320/117
6,055,312 A 4/2000 Pralus et al.
7,187,948 B2 3/2007 Alden
D630,186 S 1/2011 Yang
8,094,859 B2 * 1/2012 Suematsu et al. ..... 381/384
2001/0049262 A1 12/2001 Lehtonen
2006/0005485 A1 * 1/2006 Epps et al. ..... 52/204.51
2007/0076897 A1 4/2007 Philipp
2007/0098192 A1 * 5/2007 Sipkema ..... 381/312
2007/0287380 A1 * 12/2007 Hui et al. ..... 455/41.1
2008/0192951 A1 * 8/2008 Moura ..... 381/80
2008/0268912 A1 * 10/2008 Wang ..... 455/569.1
2008/0311966 A1 12/2008 Klein
2008/0317105 A1 12/2008 Cohen et al.
2009/0010461 A1 * 1/2009 Klinghult et al. ..... 381/309
2011/0116675 A1 * 5/2011 Terlizzi et al. ..... 381/384
2011/0317844 A1 * 12/2011 Schreuder et al. ..... 381/71.6
2012/0087510 A1 * 4/2012 Sampimon et al. ..... 381/74
2012/0093334 A1 * 4/2012 Schreuder et al. ..... 381/74
2012/0189136 A1 * 7/2012 Brown et al. ..... 381/74

OTHER PUBLICATIONS

PCT International Search Report, mailed Sep. 30, 2011, in connection with International Application No. PCT/NL2011/050459.
PCT Written Opinion, mailed Sep. 30, 2011, in connection with International Application No. PCT/NL2011/050459.
Motorola Bluetooth Active Headphones S9 MotoManual, Manual No. 6809507A77-0 Motorola, Inc., 2007.
Plantronics BackBeat 903/906 User Guide, 81378-03 Rev. B, Plantronics B.V., 2009.

* cited by examiner

*Primary Examiner* — Brian Ensey
*Assistant Examiner* — Katherine Faley
(74) *Attorney, Agent, or Firm* — Kenneth B. Leffler

(57) ABSTRACT

A compact, wearable wireless headset for stereo audio reproduction contains first and second ear pieces. The ear pieces each contain a battery and a speaker, and are connected by connecting means. The first ear piece receives audio information via a short range radio, and communicates left channel audio information to the second ear piece by various means, including wirelessly, by wire, and via optical communication. In some embodiments, the battery in the second ear piece supplies power to circuitry located in the first ear piece.

18 Claims, 15 Drawing Sheets

1000

1100

FULLY INTEGRATED SMALL STEREO HEADSET HAVING IN-EAR EAR BUDS AND WIRELESS CONNECTABILITY TO AUDIO SOURCE

CROSS REFERENCE TO RELATED APPLICATIONS

This application claims the benefit of U.S. Provisional Application No. 61/377,359, filed Aug. 26, 2010, which is hereby incorporated herein by reference in its entirety.

BACKGROUND

The present invention relates generally to electronic devices, such as electronic devices for engaging in voice communications and music listening. More particularly, the invention relates to a wireless headset with increased wearing comfort.

Mobile and/or wireless items of electronic devices are becoming increasingly popular and are in wide-spread use. In addition, the features associated with certain types of electronic devices have become increasingly diverse. To name just a few of many possible examples, electronic device functionality includes picture-taking ability, text messaging capability, Internet browsing functionality, electronic mail capability, video playback capability, audio playback capability, image display capability, and navigation capability.

Electronic devices, such as digital music players (e.g., those capable of reproducing audio output from mp3 or other format files), mobile (smart) phones, and portable Personal Computers like netbooks and laptops have become a significant part of many people's everyday experiences. To make these experiences as pleasing as possible, it is desirable that the electronic devices be easy to use. The user experience of these electronic devices is enhanced considerably by wireless headsets that allow the user to freely listen to prerecorded music, listen to FM radio stations, or to engage in voice communications without being tethered to a portable but not wearable host device like, for example, a smart phone or netbook.

Wireless voice headsets applying Bluetooth® technology are used extensively to interact with mobile phones. Car legislation on hands-free calling has been part of the success of such voice headsets. Such headsets are traditionally made to provide audio output to just one of the user's ears, making them by definition capable of providing only monophonic information.

Relatively new on the market are wireless stereo headsets which can support both voice calls and stereo music listening. A few of these stereo headsets even have a built-in FM radio, which, in some embodiments, allow the user to tune to music stations without the need to communicate with the phone (or other host device). In some alternative embodiments, the FM radio is in the wireless headset, but its control circuitry (e.g., for tuning to different FM stations) is located in the phone (or other host device), with control messages being communicated via the wireless link.

The success of a wireless headset lies in its ergonomic factors, including how easy it is to handle (e.g., put on and take off) and how comfortable it is when worn. Other factors like audio performance, standby and play time and the convenience of recharging are also of importance. Current wireless stereo headsets do not offer form factors that make them really wearable. Improved designs are therefore desirable.

SUMMARY

It should be emphasized that the terms "comprises" and "comprising", when used in this specification, are taken to specify the presence of stated features, integers, steps or components; but the use of these terms does not preclude the presence or addition of one or more other features, integers, steps, components or groups thereof.

In accordance with one aspect of the present invention, the foregoing and other objects are achieved in a wireless headset device comprising a first ear piece; a second ear piece; connecting means having a first end connected to the first ear piece and a second end connected to the second ear piece; and ear piece-to-ear piece communication means for communicating audio information from circuitry in the first ear piece to circuitry in the second ear piece. The first ear piece comprises:

- a first speaker;
- a first battery;
- a power management unit connected to receive unregulated power from the first battery and to supply regulated power at a power management unit output;
- a short-range radio for receiving first digital audio information intended for reproduction by the first speaker, and second digital audio information intended for reproduction by the second speaker;
- a first codec for converting one or both of the first and second digital audio information into at least one of first analog audio information and second analog audio information; and
- means for supplying the first analog audio information to the first speaker.

The second ear piece comprises:

- a second speaker; and
- a second battery.

In some embodiments, the first ear piece includes a microphone.

In some embodiments, the first ear piece contains an FM radio.

In some embodiments having the FM radio, the connecting means includes a wire that is used as an antenna for FM reception. In some such embodiments, the FM radio derives an FM signal from a connection to the first speaker. In some alternative embodiments, the FM radio derives an FM signal from a connection to the first battery.

In some embodiments of the headset device, the first codec converts the second digital audio information into the second analog audio information; and the connecting means comprises a first pair of wires for communicating the second analog audio information from the first ear piece to one or more components in the second ear piece; and a second pair of wires for conveying unregulated power from the second battery to circuitry in the first ear piece.

In some embodiments of the headset device, the connecting means includes first and second wires that are configured to convey unregulated power from the second battery to circuitry in the first ear piece. In some such embodiments, the first and second wires of the connecting means are also configured for communicating the second digital audio information from the first ear piece to the second ear piece.

In some alternatives of such embodiments, the first ear piece comprises a first modem; the second ear piece comprises a second modem; and one of the first and second wires of the connecting means is further configured to connect the first and second modems together to enable communication of the second digital audio information from the first modem to the second modem.

In some other alternatives of such embodiments, the connecting means further comprises a third wire; the first ear piece comprises a first modem; the second ear piece comprises a second modem; and the third wire connects the first and second modems together to enable communication of the second digital audio information from the first modem to the second modem.

In yet some other alternatives of such embodiments, the first and second batteries are connected in parallel.

In still some other alternatives of such embodiments, the wireless headset comprises circuitry that by default connects the first and second batteries in parallel, and that causes the first and second batteries to be connected in series in response to a voltage level of the first and second batteries dropping below a preset threshold voltage.

In some embodiments of the headset device, the first ear piece comprises a first modem; the second ear piece comprises a second modem; and the ear piece-to-ear piece communication means is configured to communicate the second digital audio information from the first modem to the second modem.

In some such embodiments, the second ear piece comprises a second codec for converting the second digital audio information into second analog audio information that is supplied to the second speaker.

In some embodiments of the headset device, the first ear piece includes a first microphone; the second ear piece includes a second microphone; and the wireless headset device comprises circuitry coupled to receive signals generated from the first and second microphones and to generate therefrom one or more signals that are used for noise cancellation and suppression.

In some embodiments of the headset device, the first ear piece comprises a first disk and a first ear bud, wherein the first disk houses the first battery and the first ear bud houses the first speaker such that the first speaker will fit into an ear canal when worn by a user; and the second ear piece comprises a second disk and a second ear bud, wherein the second disk houses the second battery and the second ear bud houses the second speaker such that the second speaker will fit into another ear canal when worn by the user.

In some such embodiments, the first ear piece contains at least one Printed Circuit Board located on top of the first battery.

In some alternatives of such embodiments, the first ear piece contains a 2.4 GHz antenna placed at a location furthest away from the first ear bud.

In some embodiments of the headset device, one or both of the first and second ear pieces contain(s) a sensor for measuring bio-signals.

BRIEF DESCRIPTION OF THE DRAWINGS

Many aspects of the invention can be better understood with reference to the following drawings. The components in the drawings are not necessarily to scale, emphasis instead being placed upon clear illustration of the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION

The various aspects of the invention will now be described in detail in connection with a number of exemplary embodiments. To facilitate an understanding of the invention, some aspects of the invention may be described in terms of sequences of actions to be performed by elements of a computer system or other hardware capable of executing programmed instructions. It will be recognized that in each of the embodiments, the various actions could be performed by specialized circuits (e.g., analog and/or discrete logic gates interconnected to perform a specialized function), by one or more processors programmed with a suitable set of instructions, or by a combination of both. The term "circuitry configured to" perform one or more described actions is used herein to refer to any such embodiment (i.e., one or more specialized circuits and/or one or more programmed processors). Moreover, the invention can additionally be considered to be embodied entirely within any form of computer readable carrier, such as solid-state memory, magnetic disk, or optical disk containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments as described above may be referred to herein as "logic configured to" perform a described action, or alternatively as "logic that" performs a described action.

In the present document, embodiments are described primarily in the context of a portable radio communications device, such as an illustrated mobile telephone. It will be appreciated, however, that the exemplary context of a mobile telephone is not the only operational environment in which aspects of the disclosed systems and methods may be used. Therefore, the techniques described in this document may be applied to any type of appropriate electronic host device, examples of which include a mobile telephone, a media player, a gaming device, a computer, a pager, a communicator, an electronic organizer, a personal digital assistant (PDA), a smart phone, a portable communication apparatus, remote display device, etc.

Figure 1:
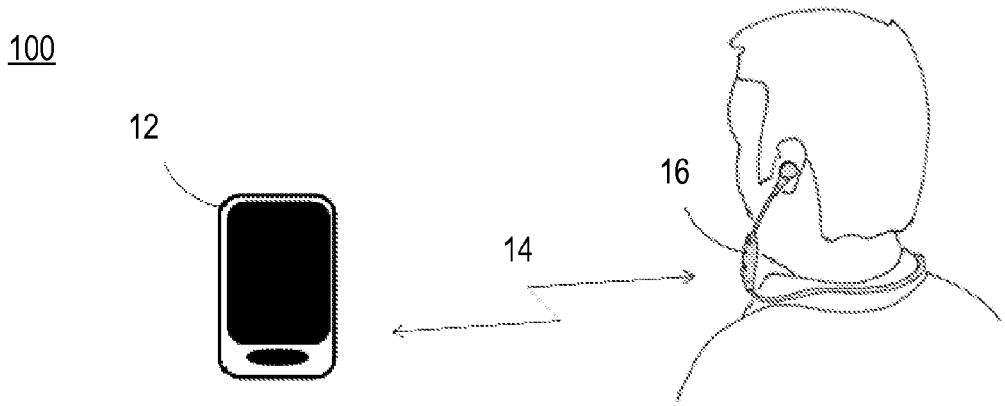
FIG. 1 is a schematic diagram of an exemplary use scenario of a particular user using a host device like a mobile phone and a wireless headset.

Electronic devices, such as mobile phones, are in widespread use throughout the world. Although the mobile phone was developed for providing wireless voice communications, its capabilities have been increased tremendously. Modern (smart) phones can access the web, contain a lot of video and music content, include many applications ("apps") that enhance the phone capabilities, provide an interface for social networking, and can even receive FM radio channels. Preferably, a phone has a large screen with touch capabilities for easy user interaction. However, large screens make the phone less attractive for any interaction with the user's ears, such as voice communications and listening to music. For those applications, the phone (or any other host device) preferably remains in the pocket or bag, and the user enjoys the applications through a small-size, wireless and wearable headset. Alternatively, the user can interact with the touch screen or buttons on the phone while simultaneously carrying a voice call or listening to music. An example of such a user scenario 100 is shown in FIG. 1. Device 12 is a device that contains audio content that it can stream over a wireless connection 14 to headset 16. In this context, the device 12 serves as a host system.

Figure 2:
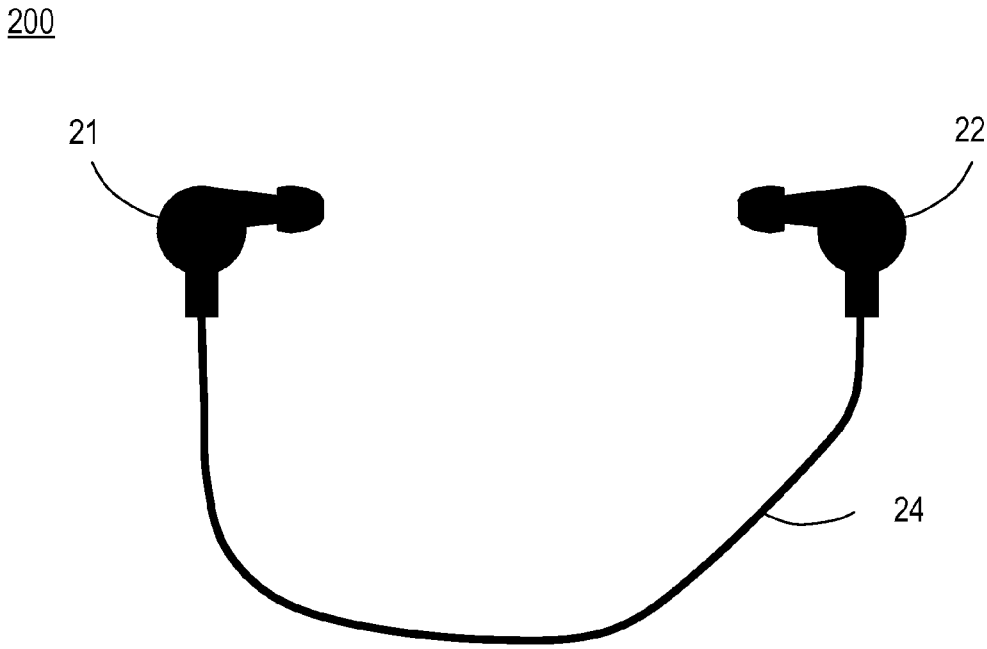
FIG. 2 is a schematic diagram of an exemplary wireless headset according to aspects of the invention.

In FIG. 2, a headset embodiment 200 is shown according to aspects of the invention. The displayed headset combines a number of features that enhance the user experience:

- Comfortable wearing experience (non-protruding ear pieces due to small size and balanced weight distribution so both ear pieces have about the same weight). Such comfort factors are exemplified by, but not required to be, such things as, for example, minimum alteration of the wearer's appearance (i.e., the headset is so small that, from a front view, no protrusion of the ear pieces is visible); the presence of only a thin wire coming out from the ear pieces; while resting one's head on a pillow, there is no discomfort wearing the headset.
- Long standby and play time due to increased battery capacity (two batteries are used instead of one, creating the possibility of doubling playing time) while keeping a small form factor.
- Acceptable FM radio reception (comparable to a wired headset connected to a mobile phone) with performance being predictable because the antenna is in a fixed position with respect to the body and the head while wearing the headset (in contrast to a wired headset in which the performance of the antenna embedded in the wire to the phone can vary considerably depending on the way of carrying the phone).

The headset comprises three individual entities: a right ear piece 21, a left ear piece 22, and a connecting means 24 connecting the ear pieces 21 and 22 to one another. The connecting means 24 can take any of a number of forms, such as a cable, cord, band, and the like. These various forms can exhibit different degrees of flexibility, ranging from relatively stiff (e.g., a relatively rigid head or neckband) to extremely pliant (e.g., a very thin cable capable of being folded or wrapped into a very small bundle for easy storage and portability).

Figure 3:
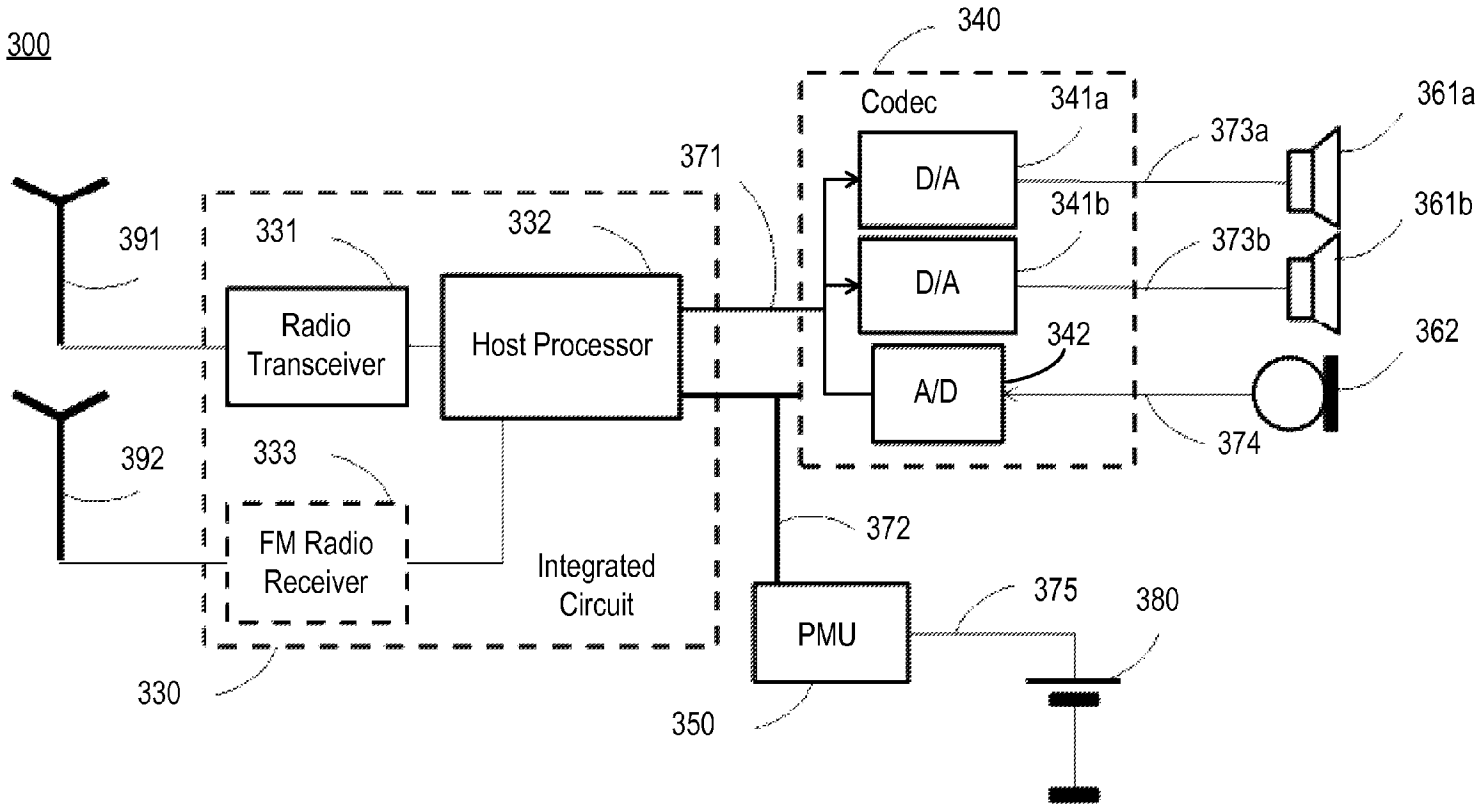
FIG. 3 is a schematic block diagram of relevant portions of an exemplary wireless headset consistent with embodiments of the invention.

FIG. 3 shows a generalized block schematic 300 of a stereo wireless headset in accordance with aspects of embodiments consistent with the invention. Wireless communication between the phone (or any other host device) and the headset is provided by the antenna 391 and the radio transceiver 331. The latter is a low-power radio covering short distances, for example a radio based on the Bluetooth® standard (operating in the 2.4 GHz ISM band). The use of a radio transceiver 331, which by definition provides two-way communication capability, allows for efficient use of air time (and consequently lower power consumption) because it enables the use of a digital modulation scheme with an automated repeat request (ARQ) protocol.

In alternative embodiments, a receive-only device for streaming audio applications (just like the FM receiver) can be used in place of the transceiver 331. In such embodiments, however, the wireless link would be less robust because no acknowledgements (ACKs) can be given when data packets are received. The use of a more robust modulation scheme (e.g., FM or FEC) can be used to compensate for this deficiency, however.

A host processor 332 controls the radio transceiver 331 and applies audio processing (for example voice processing like echo suppression and music decoding) to the signals exchanged with the radio transceiver 331. In addition to a short-range radio transceiver 331, some but not necessarily all embodiments include an FM radio receiver 333 coupled to a second antenna 392 in order to receive FM signals (typically in the band 76-108 MHz). The radio(s) 331, 333 and host processor 332 may be integrated into the same (silicon) integrated circuit chip 330.

The digital audio signals are carried over an audio interface 371 (for example a PCM interface) between the host processor 332 and a codec 340. The codec 340 includes two Digital-to-Analog converters 341*a*, 341*b* (for respective right and left channel information). The output of the D/A converter 341*a* connects to a right speaker 361*a*; the output of the D/A converter 341*b* connects to a left speaker 361*b*. For embodiments that include a voice mode (i.e., some embodiments provide audio listening capacity only), the codec 340 further includes an Analog-to-Digital (A/D) converter 342 that receives an input signal from a microphone 362. As is well known in the art, a "speaker" transduces electrical signals into acoustic signals, and a "microphone" transduces acoustic signals into electrical signals. These connections are made via wires 373*a*, 373*b*, and 374, respectively. To avoid cluttering the figure, ground (or return) wires for the speaker and microphone are not shown. A Power Management Unit (PMU) 350 provides the stable voltage and current supplies for all electronic circuitry. The PMU 350 is controlled by the host processor 332 via a data interface 372 (for example an I2C interface). The data control interface 372 is also used to communicate between the host processor 332 and the codec 340. Finally, all power in the device is delivered by the battery 380, which typically provides a 3.7V voltage. The supply current is carried over a wire 375 (a ground wire is not shown). Battery 380 can be a primary battery or a rechargeable battery.

Figure 4A:
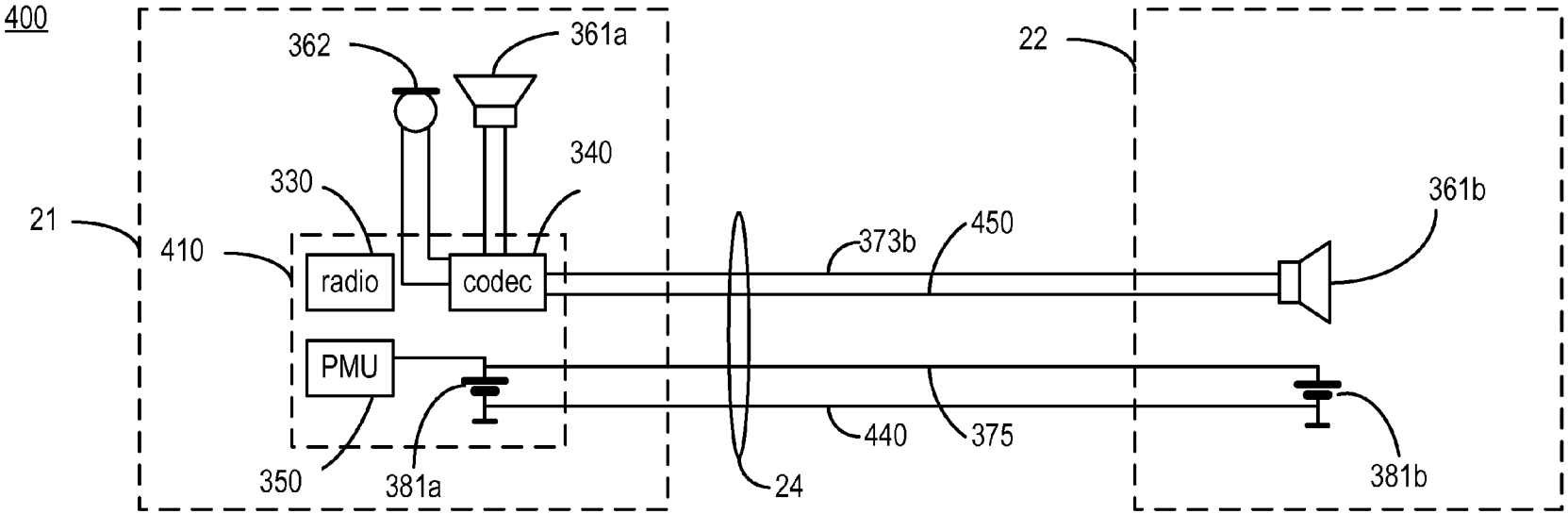
FIG. 4*a* is a detailed schematic diagram of a first embodiment consistent with aspects of the invention.

A first embodiment of a wireless headset 400 consistent with aspects of the invention is shown in FIG. 4*a*. The right and left speakers 361*a* and 361*b* are located in the right and left ear pieces 21 and 22, respectively. The single battery 380 is replaced by two (possibly smaller) batteries 381*a* and 381*b*, which are located in the right and left ear pieces 21 and 22, respectively. The two batteries 381*a* and 381*b* together provide the same or comparable functionality as that provided by the single battery 380 and can even be sized to provide more power storage capacity. For example, if the original battery has a capacity of 80 mAh, then the two smaller batteries can each have a 40 mAh capacity. Other power source allocations are possible as well, and might be better suited depending on the overall design. To take just one of many possible examples, one of the batteries can have a capacity of 30 mAh and the other can have a 50 mAh capacity if one ear piece needs more space for additional components (for example sensors) than the other. By providing total battery functionality in the form of a plurality of distinct physical batteries, a smaller overall form factor can be obtained. Alternatively, by using a plurality of distinct physical batteries, the overall power capacity can be bigger, yet maintaining acceptable small size of the individual elements the physical batteries are placed in. For example, a headset containing two batteries of 60 mAh each in two ear pieces is more attractive than a headset containing a single battery of 80 mAh in a single ear piece. In the first option, the ear pieces can be smaller, yet the overall power capacity has increased. An additional advantage is the balanced weight distribution between the two ear pieces as the batteries form the bulk of the weight of an ear piece. Ear pieces usually have a round form factor which is also the form factor that gives the highest energy density for batteries.

Figure 4B:
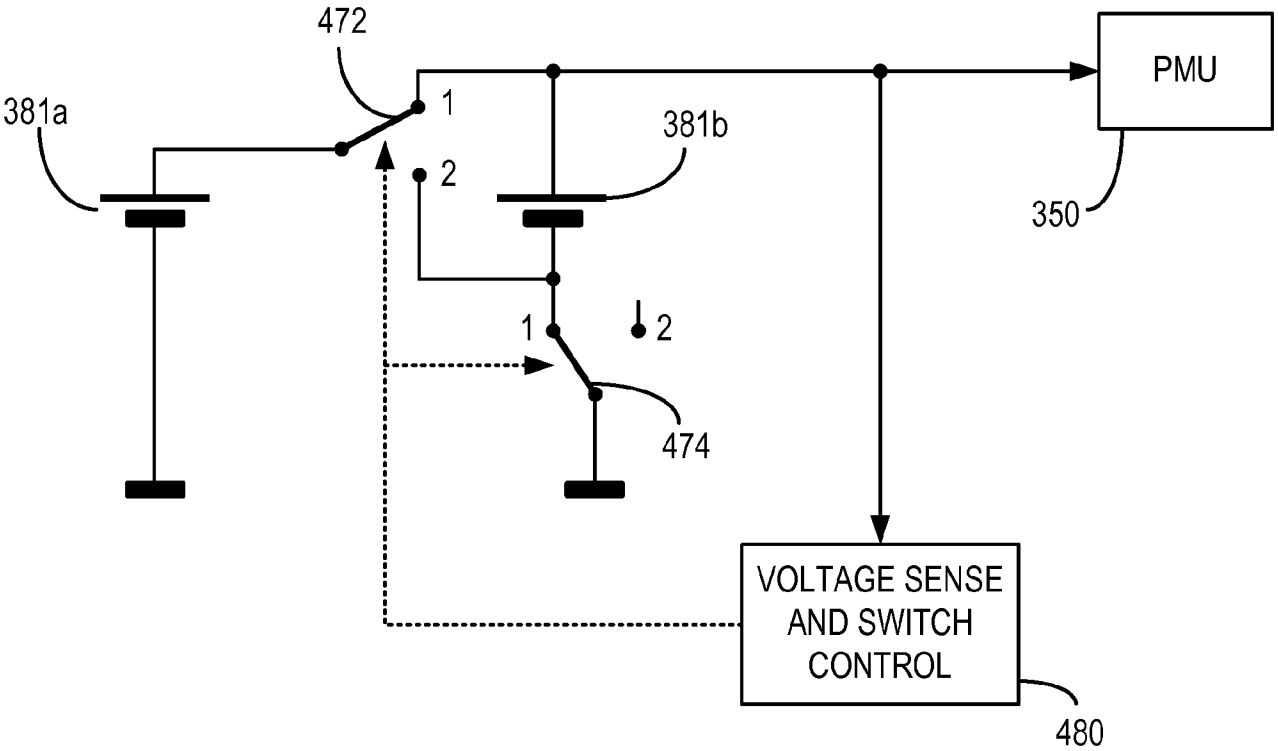
FIG. 4*b* is a detailed schematic diagram showing switching circuitry for switching between a parallel to series connection of two batteries consistent with aspects of embodiments of the invention.

From an electrical point of view, the batteries are connected in parallel. This has the advantage of allowing an easy recharge mechanism because only a single recharging point is required. However, parallel connection of the batteries is not an essential aspect of the invention. In alternative embodiments, the batteries could be connected in series. In still other alternatives, the batteries need not be coupled to one another, but instead are each arranged to supply power to a corresponding distinct partition of circuitry within the headset. In this latter alternative, two separate charging points would be needed, but this may not be a problem when wireless charging is applied. In yet another alternative embodiment, circuitry is provided that is connected to the batteries 381*a*, 381*b*, and that causes the batteries 381*a*, 381*b* to be switched from connection in parallel to connection in series when the battery voltage arrives below a threshold voltage (for example 2V). FIG. 4*b* is s schematic diagram showing exemplary switching circuitry for use in such embodiments. In normal operation, including when being recharged, the batteries are connected in parallel. In the exemplary embodiment of FIG. 4*b*, this means that switch 472 is in position 1 and switch 474 is in position 1. However, during operation, the batteries are discharged which will result in a decrease of the battery voltage. For example, typical rechargeable batteries have a voltage of 4V when fully charged. During operation, the voltage slowly drops. When the voltage drops below say 2V, the product is usually turned off since all electronics require a minimum supply voltage (e.g. the PMU 350 in exemplary embodiments may require a 2V input voltage to be able to provide a stable 1.8V supply voltage to the electronic circuitry). A sensing circuit 480 measures the battery voltage of the parallel configuration and changes the battery connection configuration to change to connection in series by controlling the position of the switches 472, 474 when the battery voltage drops below, for example, 2V. By placing each switch 472, 474 in position 2, the batteries are connected in series. The combined series connection would raise the voltage entering the PMU 350 from 2V to 4V. In this way, battery life is prolonged. Voltage levels stated only serve as an example; with other battery and electronic circuitry, other voltage levels could be needed. This technique can particularly be of interest when supercaps or goldcaps are used as an energy source. Other self-contained energy sources like fuel cells or alternative energy sources that harvest energy from the environment through, for example, light, motion, and/or temperature differences could be considered as well.

The batteries provide power to the electronic circuitry on Printed Circuit Board (PCB) 410 in the ear piece 21. PCB 410 contains all active components: the radio unit 330 (containing the radio transceiver 331, the host processor 332, and in some embodiments also the FM radio 333), the codec 340 (containing the A/D converter 342 and D/A converters 341*a*, 341*b*), and the PMU 350. Ear piece 21 may, in some alternative embodiment, also contain a microphone 362 for voice communications. To control the headset, button switching devices ("buttons") can be placed on the ear piece 21 (not shown). Buttons can be used as a user interface (UI) allowing the user to turn the wireless headset on and off, to control volume, to play-next-skip tracks, and so on, as is known in the art. Instead of buttons, a touch sensitive user interface may be applied (not shown). A microphone, one or several buttons, and or a touch sensitive user interface can be located in the ear piece 22 as well; however, this would require extra wiring in the connecting means 24.

In some of the embodiments, the connecting means 24 contains a number of wires that carry power supply and signals. In this first described embodiment, the number of wires is limited to only four (4) wires: a positive battery wire (375), a negative battery wire (ground, 440), an analog signal line for the speaker (373*b*), and an analog ground for the speaker (450). The inventors recognize that in alternative embodiments, the number of wires per connecting means can be reduced to three (3) having the analog ground for the speaker being shared with the battery ground. This alternative embodiment has a detriment, however, in that the battery ground has too much series resistance. Consequently, glitches caused by the radio/electronic circuit would be noticeable in the audio signal. The four wire embodiments avoid this problem. The wire 375 that provides the power from the battery in the ear piece 22 to the PCB 410 in ear piece box 21 is connected to the PMU 350. The two batteries are connected in parallel via the wire 375.

One or more of the wires in connecting means 24 may also act as the antenna 391 for the radio 330 (e.g., Bluetooth® radio).

In an alternative embodiment, the number of wires in the connecting means 24 can be further reduced. This can be achieved by replacing the two signal wires carrying the analog signal to the speaker 361*b* with a single wire carrying digital signals. This requires a PCB 420 in the ear piece 22 and more electronic circuitry in the ear piece 21 as is shown in the exemplary headset 500 depicted in FIG. 5. This embodiment includes a positive battery wire 375, a digital signal wire 520, and a ground wire 550. The ground wire 550 serves both for the power supply ground and for the digital signaling ground. Modems 510*a* and 510*b*, located in the respective right and left ear pieces 21, 22, are used to transfer the PCM audio data and control signaling information over the signal line 520. The modems 510*a*, 510*b* could for example apply Bluetooth® baseband modulation.

Note that codec functionality (i.e. the D/A converters and the filtering) has been divided up into two codecs 340*a*, 340*b*, one in each of the ear pieces 21, 22. Another codec function (A/D and filtering) may still be provided in the codec 340*a* in the right ear piece 21 to support the microphone functionality (assuming that the headset is configured to provide for microphone functionality, which is not necessarily the case in all embodiments). In addition, PMUs 350*a* and 350*b* are required in respective ones of the right and left ear pieces 21, 22 to provide stable voltages to the codecs 340*a*, 340*b* and modems 510*a*, 510*b*. In yet other alternative embodiments, no separate digital signal wire 520 is used. Instead the digital signals are multiplexed on the positive battery wire 375 as is shown in the exemplary headset 600 depicted in FIG. 6. A single ground wire 550 serves as both the digital signal ground and the power supply ground. In such embodiments, decoupling circuitry is needed to separate the DC power supply path from the digital signals.

In still other embodiments consistent with the invention, only a single wire is used to connect the right and left ear pieces 21, 22. The wire serves only to provide antenna functionality for FM reception and communications between the headset 16 and the host device 12. If FM reception is not desired, the connecting means 24 may have no metal wires at all (a connecting means may still be desired to keep the ear pieces together and for easy handling and storing). In this case, each ear piece needs its own battery and means for stabilizing the battery power (e.g., a PMU). When no metal wires are involved, the signaling by the modem 510*a* to the modem 510*b* can be achieved by optical means (e.g., using an optical fiber between the ear pieces) or wirelessly. In the latter case, capacitive and/or inductive coupling or a short-range radio could be used. An exemplary headset 700 depicted in FIG. 7 uses no wires at all. (A connecting means 24 is depicted in dotted lines to illustrate that some but not all embodiments may still use this for reasons stated above, i.e., to keep the ear pieces together and for easy handling and storing.) In an FM application, a single wire could be added which would serve only as an FM antenna. The FM radio receiver can be located in either of the ear pieces 21, 22.

To further enhance user satisfaction, an easy-to-use charging method for recharging the batteries is desired. In some embodiments, this is achieved by placing connectors for recharging in either the right or left ear pieces 21 or 22. Alternatively, a wireless charging mechanism is applied, either at one or at both ear pieces 21, 22, or in the connecting means 24. The batteries 381*a*, 381*b* are preferably connected in parallel (for the DC path) such that a single wired or wireless recharging point suffices.

If FM functionality is embedded in the headset, an FM antenna 392 is required for optimal reception. In the headsets 400, 500, 600, and 700 depicted in FIGS. 4, 5, 6, and 7 respectively, one or more wires in the connecting means 24 (the multiple wires in connecting means 24 wires are capacitively and inductively coupled and act as a single antenna for FM frequencies) may act as antenna 392 for the FM radio 333. Proper electrical decoupling between the wires in the connecting means 24 on the one hand and the PCB 410 on the other, is required to obtain sufficient antenna efficiency at FM frequencies. Furthermore, impedance matching is needed where the wires connect into PCB 410 in order to achieve a proper separation between the RF signals on the one hand and the analog and power supply signals on the other hand. Since the FM antenna is embedded in the connecting means 24 that connects the right and left ear pieces 21, 22 a predictable and relatively constant FM performance is experienced.

Figure 8A:
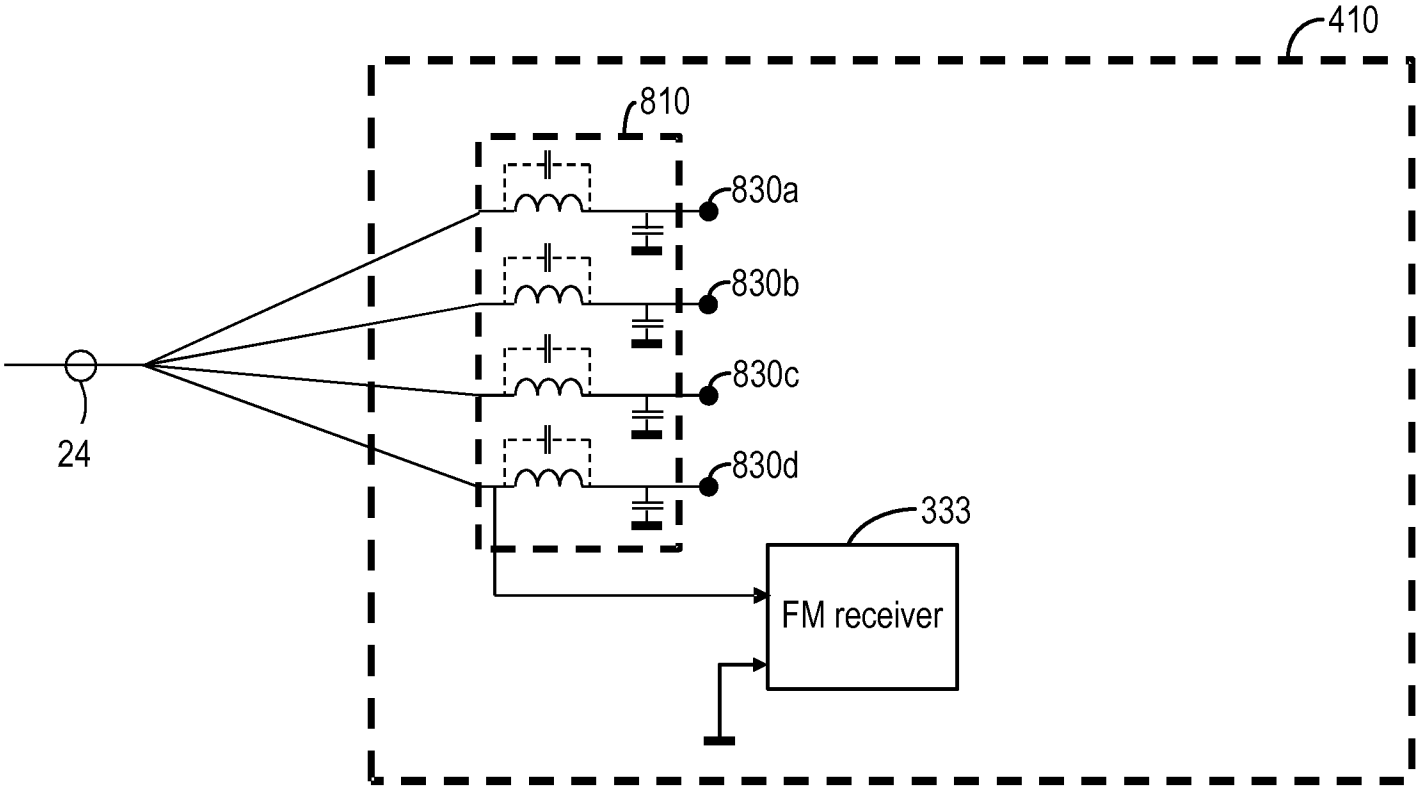
FIG. 8 shows several embodiments of the matching of the FM antenna.
Figure 8B:
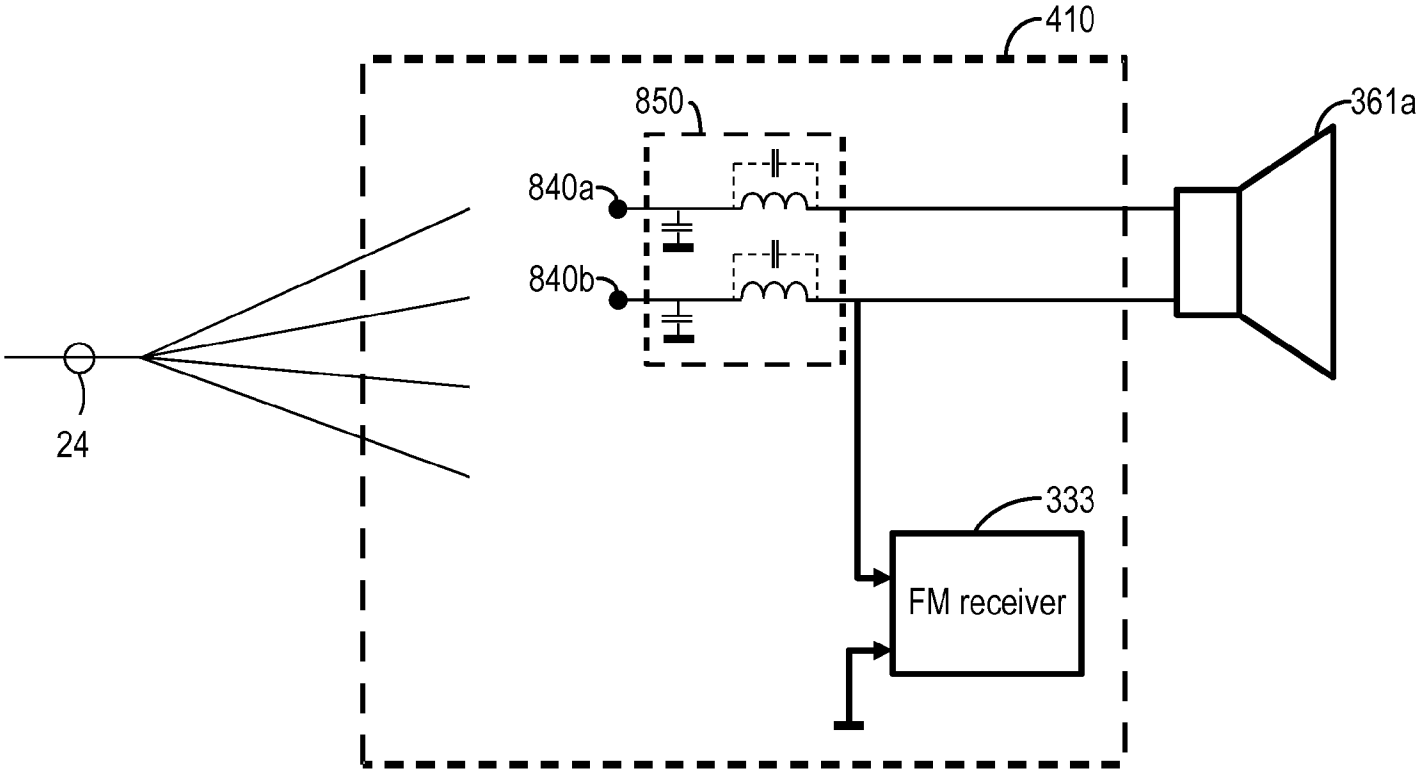

Several alternative embodiments for constructing the FM antenna exist. In FIG. 8*a*, the electrical diagram of the decoupling construction is shown. A dipole antenna may be considered: connecting means 24 is one side of the dipole—the human body can be considered the other side of the dipole (or can be considered as a ground plane of the antenna). Note that FIG. 8*a* only shows the ear piece 21 with the FM radio receiver located on PCB 410. When entering the PCB 410 in ear piece 21, a bank of notch filters 810 is embedded to decouple the antenna in connecting means 24 from the PCB 410 for FM frequencies (note that four notch filters are shown; however, the number of required notch filters equals the number of wires in the connecting means 24). The notch filter bank 810 provides a barrier for the FM signals (around 100 MHz) and could be implemented by a combination of high-pass and low-pass filters. The outputs of the notch filters 830*a-d* are practically grounded for the FM signals (e.g. the ground of the PCB 410). The FM signal is derived from one of the wires (all wires are coupled for FM frequencies anyway). The PCB 410 is capacitively coupled to the human body which forms the other part of the dipole antenna. An alternative embodiment for the decoupling construction is shown in FIG. 8*b*. Here, connections 840*a*, 840*b* are made to either one of the D/A converters 341*a* and 341*b*, with the wire coupled at connection 840*a* being either one of the signal wires 373*a* and 373*b* (see FIG. 3) and the wire coupled at connection 840*b* being a corresponding ground or return wire (not shown in previous figures). In this case the incoming wires are not decoupled (and can therefore be considered to connect to the ground of the PCB 410 for FM frequencies). Instead, the FM signal is tapped from the speaker 361*a*. Speaker 361*a* is located in the ear canal of the human body and therefore has a stronger coupling to the human body than PCB 410. In order to isolate the speaker from the PCB ground, a notch filter bank 850 is used to stop the FM signals from flowing to PCB ground. Note that the number of notch filters has been reduced to two since only two wires from the speaker enter the PCB 410. Alternatively, the FM signal is not tapped from the speaker wire but from the metal casing or housing encompassing the speaker (this configuration is not shown). This speaker housing has an even larger coupling to the human body. Since the speaker housing also has a large coupling to the speaker itself, the notch filter bank 850 would still be needed.

Figure 8C:
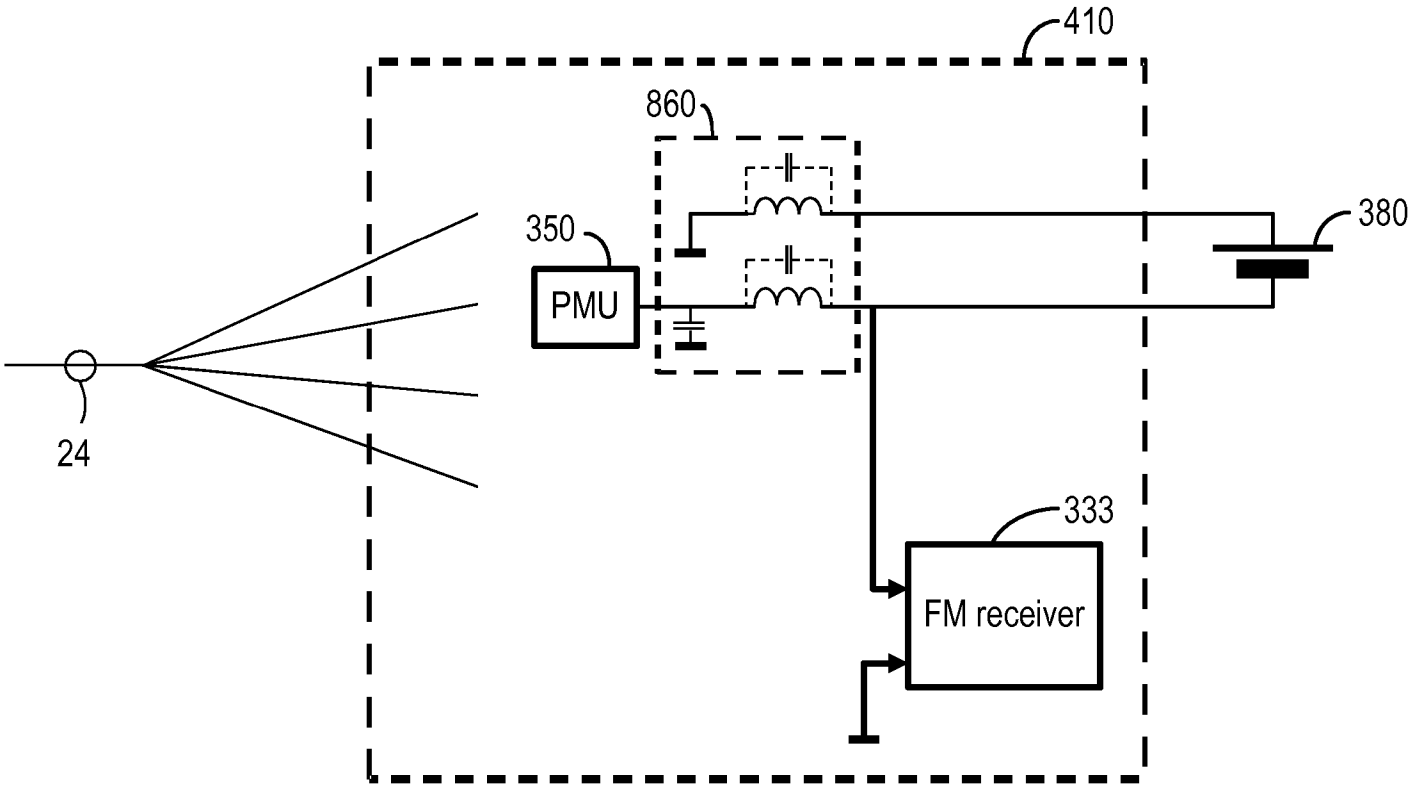

Yet another embodiment for the FM antenna solution is shown in FIG. 8*c*. In this case, the FM signal is derived from the battery poles. The battery is the largest component in ear piece 21 and also has a large coupling to the human body. To isolate the battery poles from PCB ground, a notch filter bank 860 with two notch filters is needed.

The antenna 391 for the 2.4 GHz radio may be embedded in the connecting means 24 also, but is preferably mounted on the ear piece 21. The antenna 391 will be located as far from the user's head as possible as will be described in further detail below. This position assures a stable and predictable radio performance of the wireless link (e.g., to the device 12).

Figure 9:
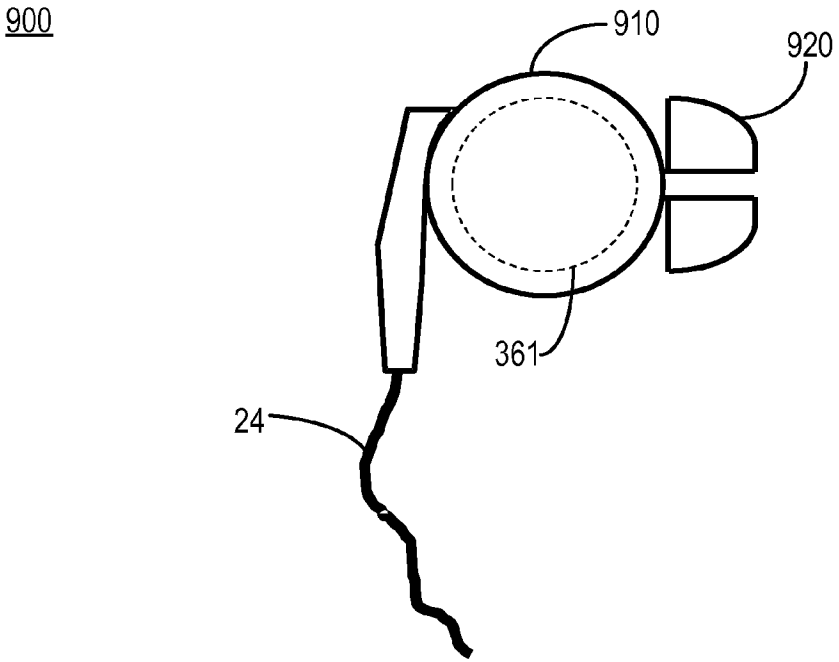
FIG. 9 is a first example of an ear piece embodiment consistent with embodiments of the invention.

For optimal wearing comfort, the design of the ear pieces 21 and 22 is very important. High quality ear pieces use disk speakers with a mechanical part (ear bud) that fits into the ear canal. A typical ear piece is shown in FIG. 9. This is a configuration commonly found for wired headsets (where only analog audio signals are provided to the ear pieces by the host system). The ear piece consists of two parts: a disk 910 that contains a large speaker 361 and a bud 920 that fits into the ear canal. The bud 920 merely uses a small pipe that ends in the ear canal and carries the acoustical signals from the speaker 361 into the ear canal. In exemplary embodiments consistent with the invention, this same mechanical design is used for a wireless stereo headset. However, in accordance with an aspect of embodiments consistent with the invention, the disk 910 is not used for the speaker 361 but instead holds a (possibly re-chargeable) coin-cell battery 381*a* or 381*b*.

Figure 10:
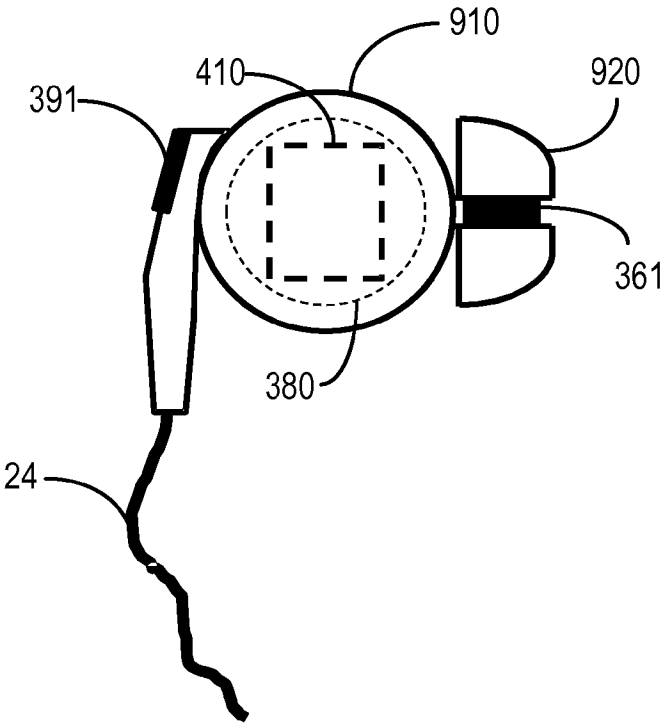
FIG. 10 is a second example of an ear piece embodiment consistent with embodiments of the invention.
Figure 11B:
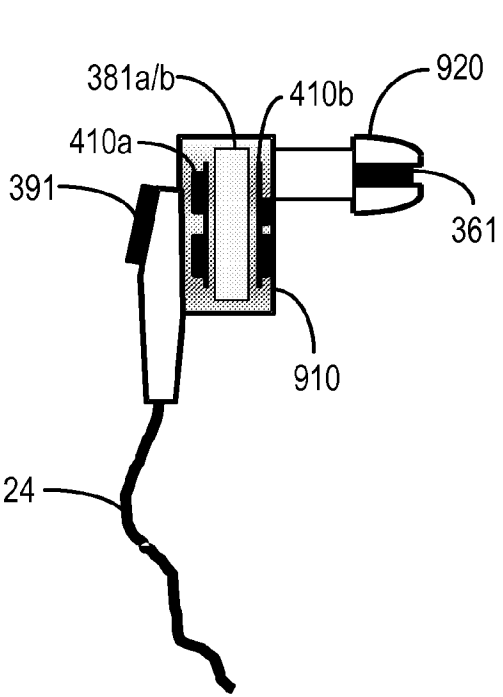
FIGS. 11*a* and 11*b* are respective third and fourth examples of ear piece embodiments consistent with aspects of the invention.
Figure 11A:
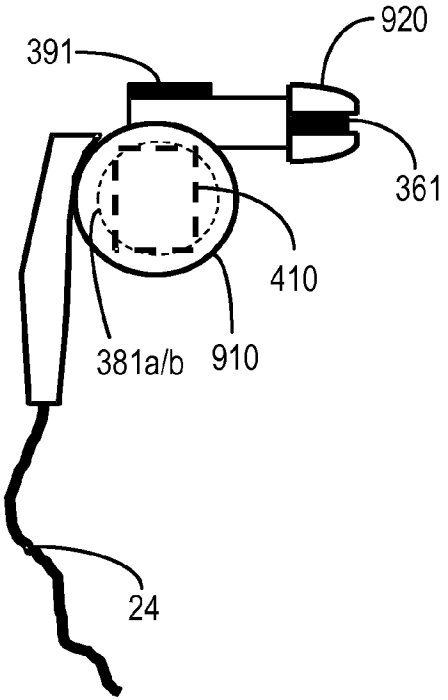

An exemplary embodiment 1000 of such an ear piece is depicted in FIG. 10. The disk 910 contains at least one PCB 410. A small speaker 361 is used that fits into the ear bud, typically a speaker with a diameter of 6 mm or smaller. Because the speaker is not present in the disk 910, the open space that is left can be used for holding a (possibly coin-cell) battery 381*a* or 381*b*. Instead of a single PCB 410, an ear piece may contain more then one, such as two PCBs 410*a* and 410*b* which are fitted on either side of the coin-cell battery (see, e.g., the exemplary embodiment depicted in FIG. 11*b*, described below). A flexible connection may connect the circuitry on PCB 410*a* with the circuitry on PCB 410*b*. In the case of the architecture as shown in FIG. 4, only the right ear piece 21 will contain one or more PCBs 410. These PCBs will contain all the circuitry (including the wireless radio) as is shown in FIG. 3, except for the speaker 361*b*. The left ear piece 22 would contain only the battery 381*b* and the speaker 361*b* as was shown in FIG. 4. For the configurations shown in FIGS. 5, 6, and 7, the left ear piece 22 would contain one or more PCBs 420 as well. In FIG. 10, only an exemplary configuration is given; the relative position of the ear bud 920 with respect to the disk 910 may be different in other embodiments. FIGS. 11*a* and 11*b* depict some alternative configurations of ear pieces 21, 22 in accordance with aspects of exemplary embodiments consistent with the invention.

For optimal antenna efficiency, the antenna 391 for the 2.4 GHz radio should be placed as far away from the human body as possible. Coupling between the antenna and the human body (which can be considered to be a material with a high relative electrical permittivity $\in_r$ and large dielectric loss factor $\in''$) will seriously reduce the antenna efficiency. Therefore, the antenna 391 is placed at a location opposite the ear bud 920 as is shown in each of FIGS. 10, 11*a* and 11*b*. The disk 910 includes the 2.4 GHz radio such that the interconnection between the antenna and the radio can be optimized.

Figure 5:
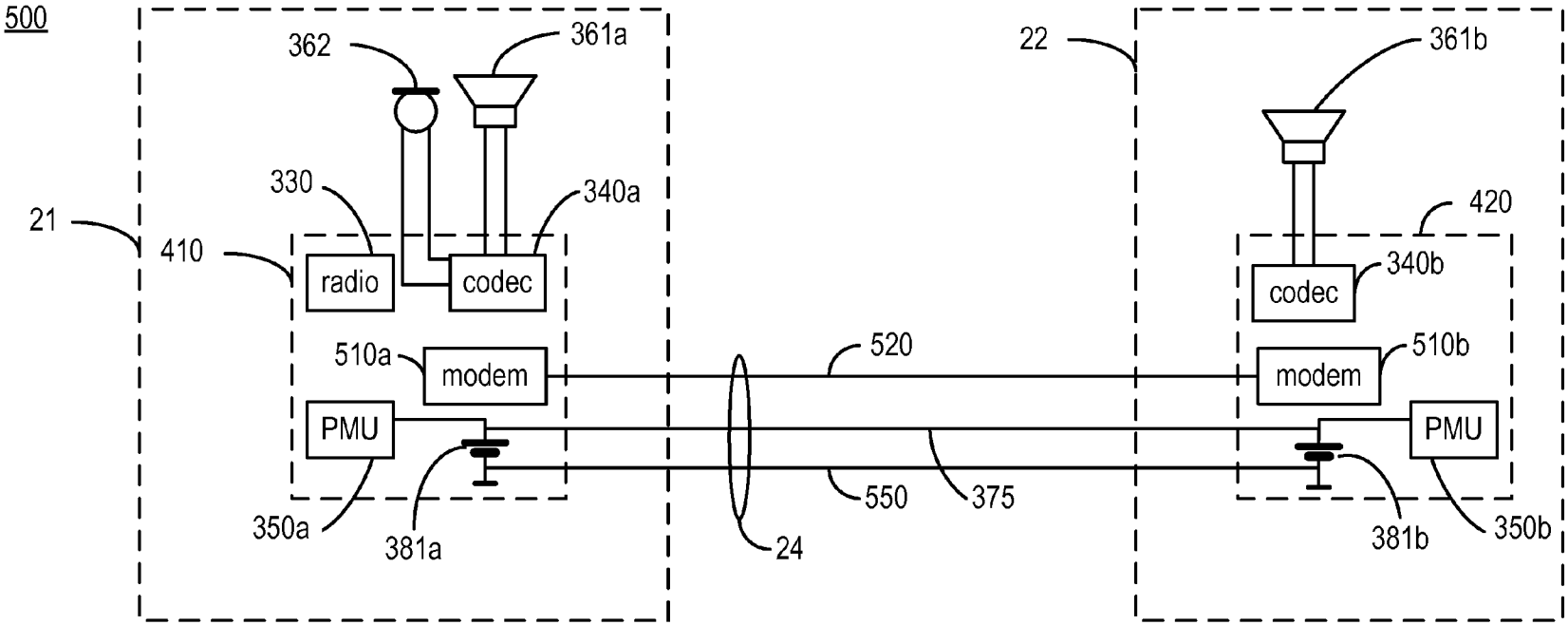
FIG. 5 is a detailed schematic diagram of a second embodiment consistent with aspects of the invention.
Figure 6:
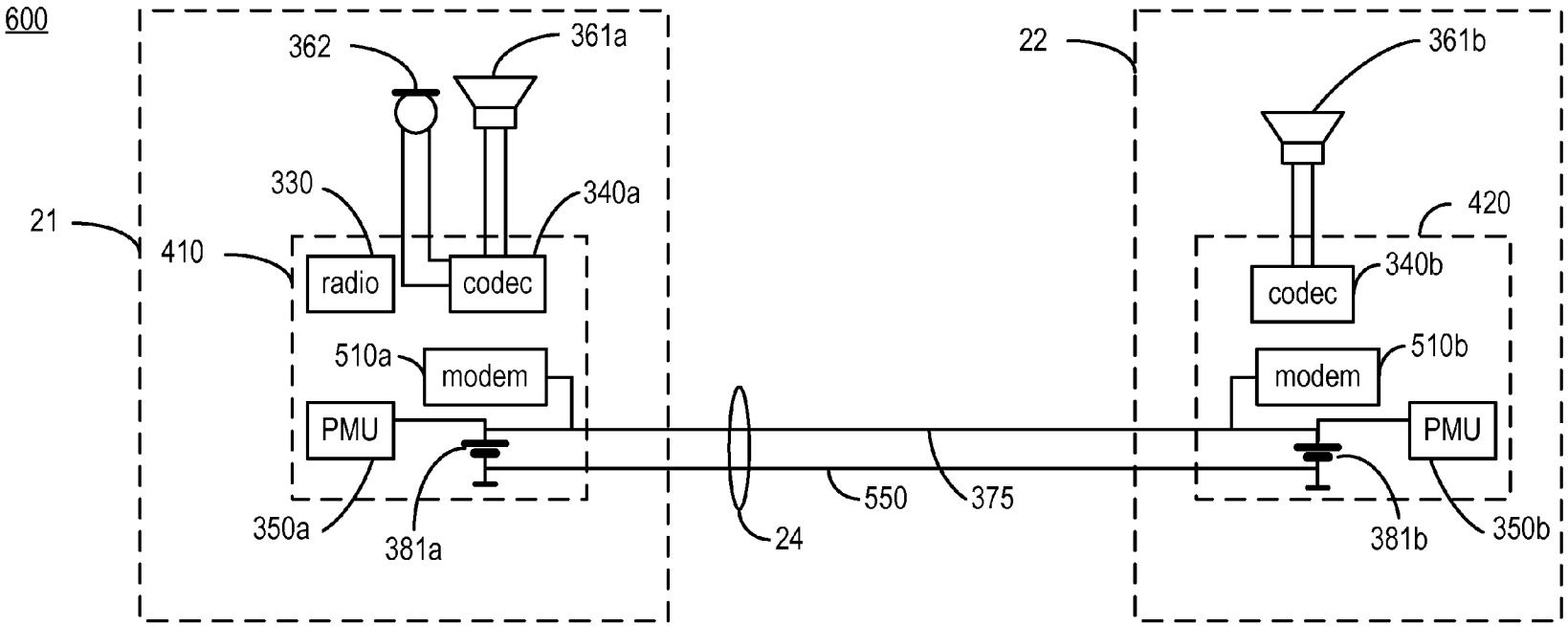
FIG. 6 is a detailed schematic diagram of a third embodiment consistent with aspects of the invention.
Figure 7:
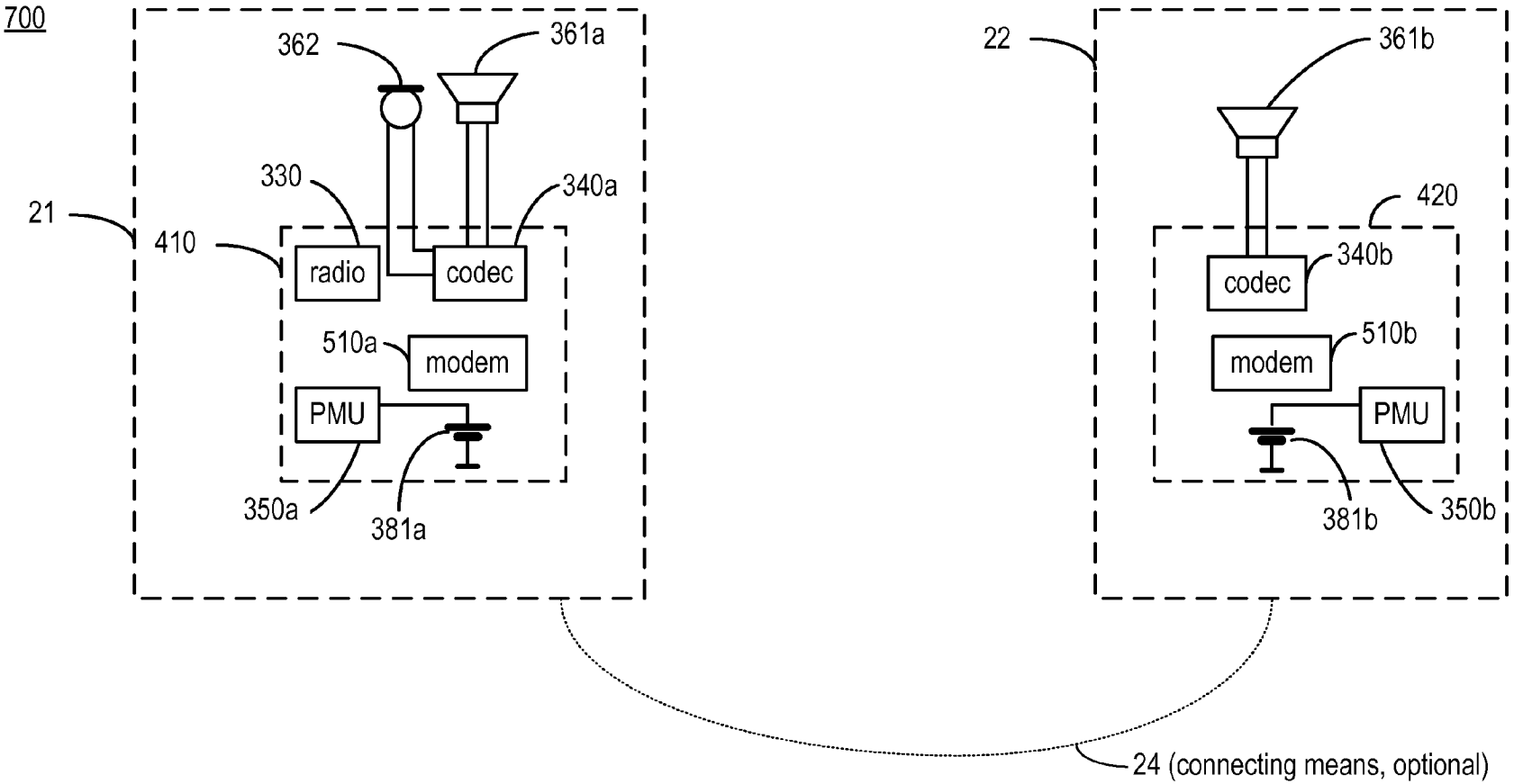
FIG. 7 is a detailed schematic diagram of a fourth embodiment consistent with aspects of the invention.

In yet other aspects of embodiments consistent with the invention, noise cancellation and noise suppression can be supported by placing (additional) microphones in the ear pieces 21 and 22 (not shown). The (additional) microphones can be positioned on the ear piece part that is located within the ear canal (ear bud 920) and/or can be positioned on the ear piece part that is located outside the ear (e.g., disk 910). When in-ear positioning of the microphone (MIC in the ear bud 920) is employed, the microphones can be used for near-end noise cancellation (so called because it benefits the user of the headset itself), that reduces the impact of environmental noise on the audio heard by the user of the headset 16. The audio (e.g., music) played in the ear is picked up by the microphones and compared to the audio provided to the speaker. Any deviation is deemed to be noise that can be cancelled by using known noise cancellation techniques that rely on this feedback to adjust the signal supplied to the speaker. The audio processing for noise cancellation may be performed in the digital domain in a Digital Signal Processor (DSP). This DSP may, for example, be located in the host processor 332. Alternatively, the noise cancellation may be performed in the analog domain, for example in an analog circuit embedded in codec 340. Additional wires would be needed in the connecting means 24 to carry the microphone signals from the left ear piece 22 to the right ear piece 21. Alternatively, these signals are multiplexed over a shared wire as was discussed in the embodiments shown in FIGS. 5, 6, and 7, provided the microphones use a shared clock to sample the audio. The clock may, for example, be derived from the bit timing in the packets sent and received by the modems 510*a*, 510*b*. The modems in such embodiments support bi-directional communications, for example by applying time-division multiplexing.

Noise suppression and noise cancellation can also be achieved with microphones positioned on the ear piece part that is located outside the ear (MIC in or on the disk 910). For near-end noise cancellation, feed-forward techniques can be used.

The concepts of noise cancellation and noise suppression can be implemented both in the embodiment of FIG. 4 as well as in the embodiments of FIGS. 5, 6, and 7. These kinds of audio processing functions are typically carried out by a digital signal processor (DSP). The DSP can be part of the host processor 332 in the embodiment of FIG. 4. In alternative embodiments like those shown in FIGS. 5-7, separate DSPs can be embedded in the ear pieces 21 and 22.

The microphones can also be used for voice pick-up. In embodiments utilizing in-ear microphones, far-end noise suppression (so-called because it benefits the user on the other side of the line, not the wearer of the headset, by reducing the impact of environmental noise on the voice) is achieved by the isolation of the ear canal itself: the ear bud 920 pushed inside the ear canal prevents environmental noise from reaching the in-ear microphone. Special attention is required for echo cancellation when in-ear microphones are used.

For far-end noise suppression, beam-forming can also be used. For beam-forming, the information picked up by the right and left microphones needs to be combined. The signals from the microphones therefore need to be fed to a central unit (e.g., a DSP on PCB 410) so they can be combined. Since the timing information (phase) in the right and left microphone is critical, additional wires are needed in the connecting means 24 to support beam-forming in the embodiment of FIG. 4. No additional wires are needed in the embodiments of FIGS. 5-7 provided the microphones use a shared clock to sample the audio. The modems 510*a*, 510*b* in such embodiments support bi-directional communications, for example by applying time-division multiplexing.

Figure 12:
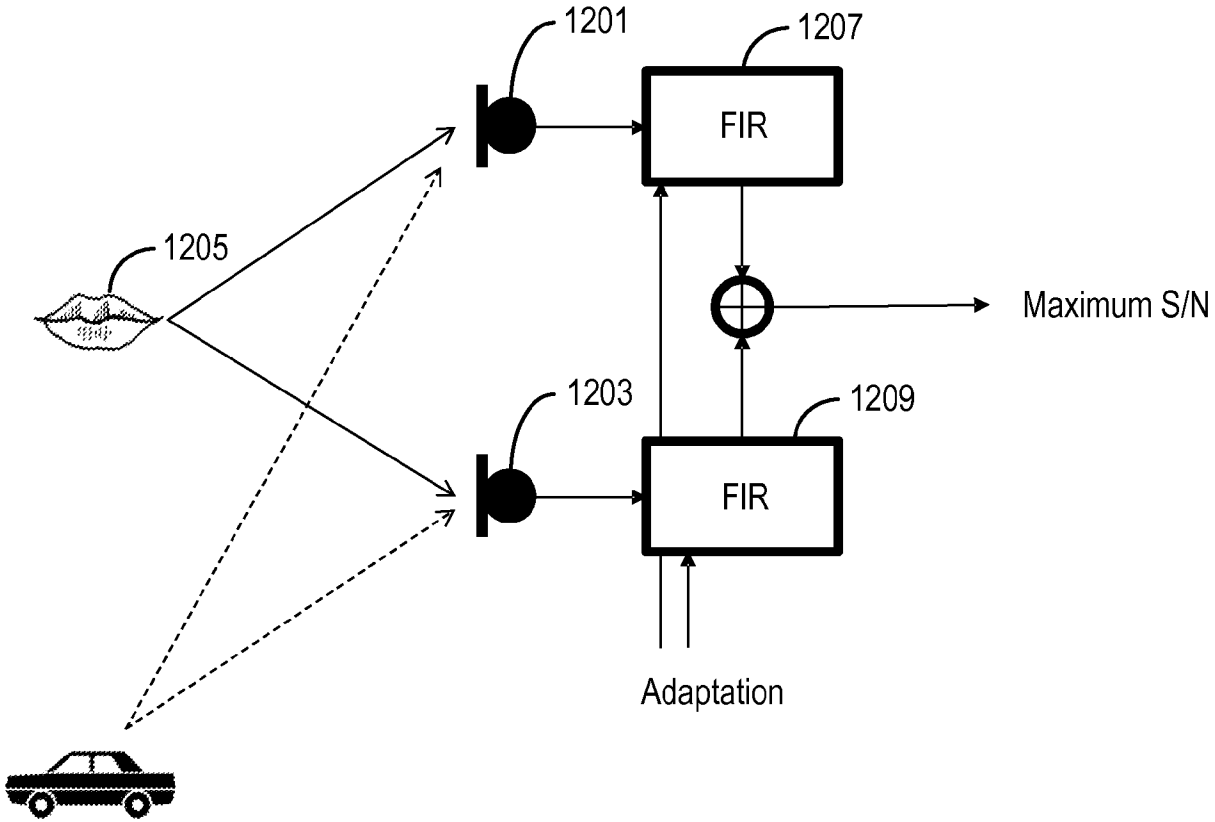
FIG. 12 illustrates beamforming concepts that can be employed in embodiments consistent with the invention.

The discussion will now focus on far-end noise-suppression techniques with two microphones and beam forming. FIG. 12 illustrates beam forming concepts. The signals arriving at the microphones 1201, 1203 are correlated. Knowledge of the phase difference between the signals originating from the same source and arriving at the microphones 1201, 1203 allows the signals to be combined constructively using audio filters in a processing unit. All other signals can be combined destructively so that they are suppressed as much as possible. This achieves a high differentiation between the desired signal and the undesired signals.

The direction of the desired source (e.g., speech source 1205) needs to be known in order to get the proper phase relationships. Therefore, the source needs to be identified. To achieve this, the noise-suppression algorithm is configured to include a speech detection algorithm that identifies speech. When speech is detected, an adaptation algorithm is invoked to determine the phase relation for the voice source. This phase relation is then used to enhance the voice signal in the received signals from both microphones 1201, 1203. The noise-suppression algorithm has a presetting based on the position of the microphones 1201, 1203 (at the two ears in the case of the wireless headset) and the mouth. The algorithm tries to find the optimum spot of the mouth within a cone-shaped volume of space.

Each of two finite impulse response (FIR) filters 1207, 1209 receives signals from a respective one of the two microphones 1201, 1203. The FIR filters 1207, 1209 filter the microphone signals and provide the proper phase relationships. The FIR filter coefficients are variable. The coefficients determine both the amplitude and the phase response. An adaptive algorithm varies the coefficients such that a maximal signal-to-noise (S/N) (or signal-to-interference, S/I) ratio is achieved.

In an alternative embodiment, the parameter settings of the FIR filters 1207, 1209 are not variable but fixed. Since the two microphones 1201, 1203 have predetermined positions (one microphone at each ear position), the relative location of the mouth can be predicted. Based on this prediction, fixed parameters can be determined which are programmed in the FIR filters 1207, 1209. This is also called Blind Source Separation (BSS).

In addition to audio functionality, the headsets shown may also include sensing capabilities. For example, the microphones placed in the ear pieces for noise cancellation and/or voice pickup may also be used for the pickup of bio-signals such as, but not limited to, heart rate or breathing rate. These signals may be forwarded from the right and left ear pieces 21, 22 to the PCB 410. The bio-signals can be processed by electronic circuitry on PCB 410 and/or can be communicated wirelessly from the headset 16 to an external host device (e.g., a mobile phone or a personal computer) for processing.

Figure 13:
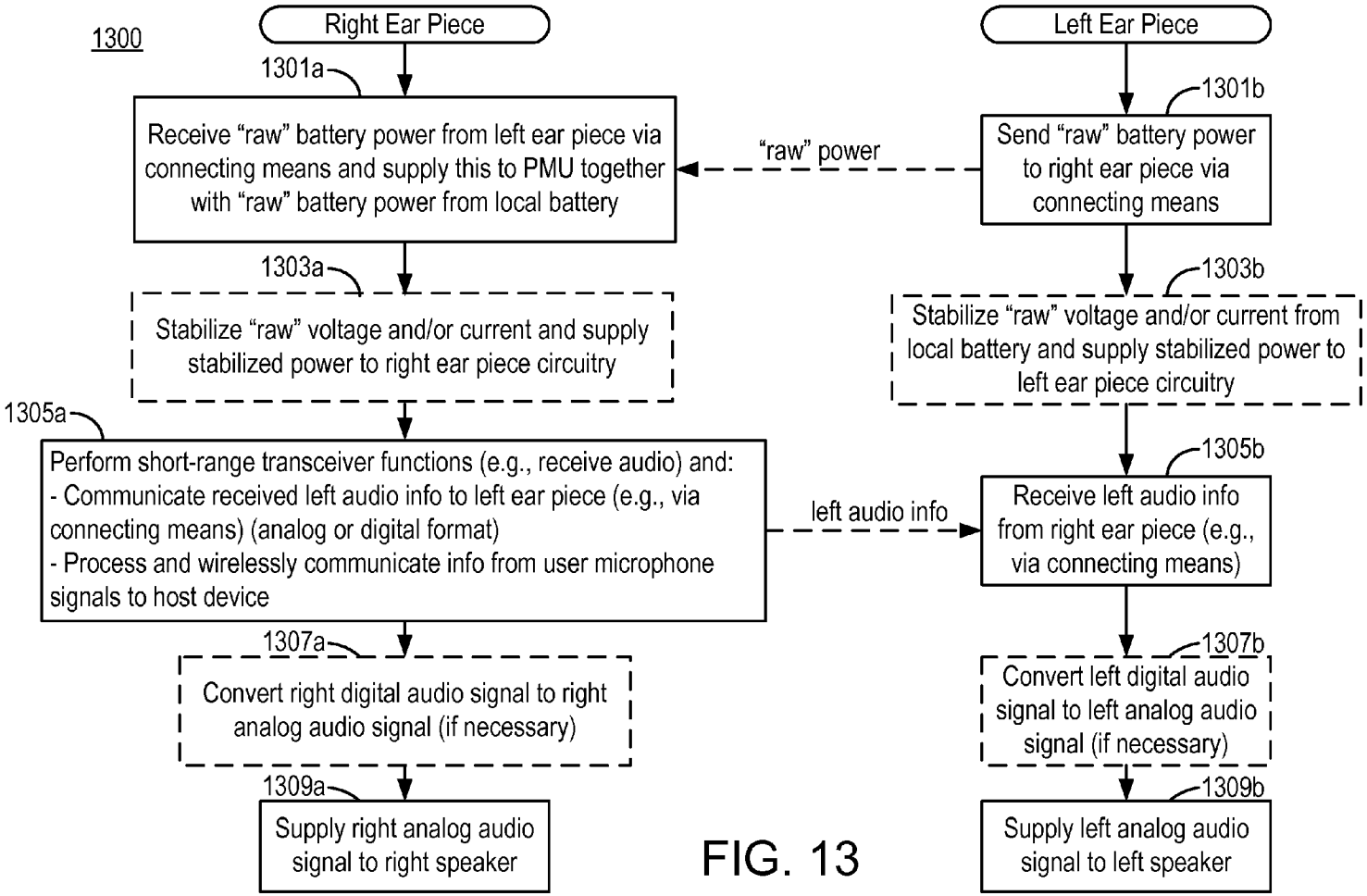
FIG. 13 is, in one respect, a flow diagram of steps/processes performed in exemplary embodiments consistent with the invention.

FIG. 13 will now be described which is, in one respect, a flow diagram of steps/processes performed in accordance with one or more exemplary methods consistent with the invention. In another respect, FIG. 13 can be considered to schematically depict device circuitry 1300 comprising the illustrated functionally described components (i.e., means for performing the described functions).

To facilitate the reader's understanding, FIG. 13 is divided into two columns, with each individual column representing steps/processes/means all associated with a single one of two distinct entities: the right ear piece 21 and the left ear piece 22. The description begins with the mechanism by which all of the device circuitry 1300 is powered. As mentioned earlier, each of the ear pieces 21, 22 includes a battery 381*a*, 381*b*. These batteries supply unregulated power (referred to herein as "raw" power). In some embodiments, battery 381*b* in the left ear piece 22 sends its raw power to the right ear piece 21 via connecting means 24 (step 1301*b*). (In embodiments not involving any connecting means, such as those illustrated by FIG. 7, each of the batteries 381*a* and 381*b* supplies power only to circuitry contained in its own respective one of the ear pieces 21, 22.) The "raw" power from battery 381*b* is received in the right ear piece 21 and is supplied to the PMU 350 together with the "raw" power from local battery 381*a* located in the right ear piece 21 (step 1301*a*). The PMU 350 (or 350*a*) receives the "raw" power, stabilizes the received voltage and/or current and supplies the stabilized voltage and/or current to the local circuitry in the right ear piece 21 (step 1303*a*). In some (but not necessarily all) embodiments, such as the embodiment depicted in FIG. 5, the left ear piece 22 includes its own active circuitry that requires power. In such embodiments, battery 381*b* also supplies its power to a local PMU 350*b* (i.e., local to the left ear piece 22), in which case the left ear piece 22 stabilizes its local raw voltage and/or current and supplies the stabilized power to its own local circuitry (step 1303*b*).

The stabilized power in the left ear piece 22 is supplied to the local circuitry (on PCB 420) in the left ear piece 22. This local circuitry may also perform short-range transceiver functions (similar to step 1305*a*), including:

- communicating received audio information to the left ear piece 22 via ear piece-to-ear piece communication means, such as via the connecting means 24 (e.g., wire(s) and/or optical fiber in the connection means 24) or by means of another mechanism such as those described above (e.g., capacitive and/or inductive coupling or a short-range radio); and
- processing and wirelessly communicating information from the microphone signals (e.g., generated by the microphone 362) to the host device 12.

The left ear piece 22 receives its audio information from the ear piece-to-ear piece communication means (e.g., wirelessly or via the connecting means 24) (step 1305*b*). As mentioned earlier, different embodiments can employ the connecting means 24 in different ways to communicate audio information from the right ear piece 21 to the left ear piece 22. In some embodiments, analog signals are used and in others, digital signaling is used. In case of the latter, the left and right ear piece circuitry each further performs converting its respective left/right digital audio signal into a respective left/right analog audio signal (step 1307*a*, 1307*b*).

Regardless of whether analog or digital signaling is used along the connecting means 24, left and right analog signals are supplied to respective ones of the left and right speakers 361*b*, 361*a* (step 1309*a*, 1309*b*).

It will be appreciated that in various alternative embodiments, device circuitry can perform additional steps as well, such as those involved in receiving signals from the extra noise cancellation/suppression microphones (mentioned earlier) and processing those signals to cancel/suppress noise from an audio signal to be generated by one or both of the left and right speakers 361*b*, 361*a*.

The invention has been described with reference to particular embodiments. However, it will be readily apparent to those skilled in the art that it is possible to embody the invention in specific forms other than those of the embodiment described above.

For example, in exemplary embodiments described above, various functionalities have been attributed to a "left" ear piece or to a "right" ear piece. However, it will be readily apparent that a wireless headset consistent with one or more inventive principles as set forth herein can be implemented with the roles of the left and right ear pieces (and their associated functions) being reversed. Hence, it is equally valid to describe various embodiments more generally in terms of "first" and "second" ear pieces, wherein the "first" ear piece can refer to either the left ear piece or the right ear piece, and the "second" ear piece consequently refers to the other one of the left and right ear pieces.

The described embodiments are therefore merely illustrative and should not be considered restrictive in any way. The scope of the invention is given by the appended claims, rather than the preceding description, and all variations and equivalents which fall within the range of the claims are intended to be embraced therein.

What is claimed is:

1. A wireless headset device comprising:

a first ear piece;

a second ear piece;

connecting means having a first end connected to the first ear piece and a second end connected to the second ear piece; and ear piece-to-ear piece communication means for communicating audio information from circuitry in the first ear piece to circuitry in the second ear piece, wherein:

the first ear piece comprises:

a first speaker;

a first ear bud, wherein the first ear bud houses the first speaker such that the first speaker will fit into an ear canal when worn by a user;

a first battery;

a power management unit connected to receive unregulated power from the first battery and to supply regulated power at a power management unit output;

a short-range radio for receiving first digital audio information intended for reproduction by the first speaker, and second digital audio information intended for reproduction by the second speaker;

a first codec for converting one or both of the first and second digital audio information into at least one of first analog audio information and second analog audio information; and means for supplying the first analog audio information to the first speaker; and the second ear piece comprises:

a second speaker;

a second ear bud, wherein the second ear bud houses the second speaker such that the second speaker will fit into another ear canal when worn by a user; and a second battery, wherein the connecting means includes first and second wires that are configured to convey unregulated power from the second battery to circuitry in the first ear piece, and wherein the first and second batteries are connected in parallel.

2. The wireless headset device of claim 1, wherein the first ear piece includes a microphone.

3. The wireless headset device of claim 1, wherein the first ear piece contains an FM radio.

4. The wireless headset device of claim 3, wherein the connecting means includes a wire that is used as an antenna for FM reception.

5. The wireless headset device of claim 4, wherein the FM radio derives an FM signal from a connection to the first speaker, and wherein the wireless headset device comprises a decoupler that provides FM frequency isolation between the connection to the first speaker and the wire that is used as an antenna for FM reception.

6. The wireless headset device of claim 4, wherein the FM radio derives an FM signal from a connection to the first battery, and wherein the wireless headset device comprises a decoupler that provides FM frequency isolation between the connection to the first battery and the wire that is used as an antenna for FM reception.

7. The wireless headset device of claim 1, wherein:

the first codec converts the second digital audio information into the second analog audio information;

the connecting means comprises:

a first pair of wires for communicating the second analog audio information from the first ear piece to one or more components in the second ear piece; and the first and second wires are a second pair of wires for conveying unregulated power from the second battery to circuitry in the first ear piece.

8. The wireless headset device of claim 1, wherein the first and second wires of the connecting means are also configured for communicating the second digital audio information from the first ear piece to the second ear piece.

9. The wireless headset device of claim 1, wherein:

the first ear piece comprises a first modem;

the second ear piece comprises a second modem; and one of the first and second wires of the connecting means is further configured to connect the first and second modems together to enable communication of the second digital audio information from the first modem to the second modem.

10. The wireless headset device of claim 1, wherein:

the connecting means further comprises a third wire;

the first ear piece comprises a first modem;

the second ear piece comprises a second modem; and the third wire connects the first and second modems together to enable communication of the second digital audio information from the first modem to the second modem.

11. The wireless headset device of claim 1, wherein the wireless headset comprises circuitry that by default connects the first and second batteries in parallel, and that causes the first and second batteries to be connected in series in response to a voltage level of the first and second batteries dropping below a preset threshold voltage.

12. The wireless headset device of claim 1, wherein:

the first ear piece comprises a first modem;

the second ear piece comprises a second modem; and the ear piece-to-ear piece communication means is configured to communicate the second digital audio information from the first modem to the second modem.

13. The wireless headset device of claim 12, wherein:

the second ear piece comprises a second codec for converting the second digital audio information into second analog audio information that is supplied to the second speaker.

14. The wireless headset device of claim 1, wherein:

the first ear piece includes a first microphone;

the second ear piece includes a second microphone; and the wireless headset device comprises circuitry coupled to receive signals generated from the first and second microphones and to generate therefrom one or more signals that are used for noise cancellation and suppression.

15. The wireless headset device of claim 1, wherein:

the first ear piece comprises a first disk, wherein the first disk houses the first battery; and the second ear piece comprises a second disk, wherein the second disk houses the second battery.

16. The wireless headset device of claim 15, wherein the first ear piece contains at least one Printed Circuit Board located on top of the first battery.

17. The wireless headset device of claim 15, wherein the first ear piece contains a 2.4 GHz antenna placed at a location furthest away from the first ear bud.

18. The wireless headset device of claim 1, wherein one or both of the first and second ear pieces contain(s) a sensor for measuring bio-signals.

* * * * *